US007775220B2

(12) United States Patent
Goddard

(10) Patent No.: US 7,775,220 B2
(45) Date of Patent: Aug. 17, 2010

(54) PARTS WASHER

(76) Inventor: Earl Fenton Goddard, 74B Lockhart Street, Como, Western Australia 6152 (AU)

( * ) Notice: Subject to any disclaimer, the term of this patent is extended or adjusted under 35 U.S.C. 154(b) by 852 days.

(21) Appl. No.: 10/552,960

(22) PCT Filed: Apr. 16, 2004

(86) PCT No.: PCT/AU2004/000502

§ 371 (c)(1),
(2), (4) Date: Jul. 10, 2006

(87) PCT Pub. No.: WO2004/091817

PCT Pub. Date: Oct. 28, 2004

(65) Prior Publication Data

US 2006/0266388 A1 Nov. 30, 2006

(30) Foreign Application Priority Data

Apr. 16, 2003 (AU) ..... 2003901819

(51) Int. Cl.
*B08B 3/00* (2006.01)

(52) U.S. Cl. ..... 134/103.2; 239/225.1; 239/236; 239/240; 239/243; 239/263.1

(58) Field of Classification Search ..... 134/103.2, 134/180–181
See application file for complete search history.

(56) References Cited

U.S. PATENT DOCUMENTS 2,518,239 A * 8/1950 Leigh ..... 422/185
4,741,351 A 5/1988 Minkin
5,224,503 A 7/1993 Thompson et al.
5,427,128 A * 6/1995 Minkin ..... 134/102.1

FOREIGN PATENT DOCUMENTS

| | | |
|---|---|---|
| AU | 43848/2001 | 11/2001 |
| DE | 8806774 | 7/1988 |
| DE | 10124645 | 12/2001 |
| JP | 55-73234 | 6/1980 |
| JP | 58-91489 | 6/1983 |
| JP | 59-70780 | 5/1984 |
| JP | 06-099145 | 4/1994 |

OTHER PUBLICATIONS

Supplemental European Search Report for EP 04 72 7788 (mailed Oct. 28, 2008).
Derwent Abstract Accession No. 90-340514/45 (Jan. 7, 1990).
Derwent Abstract Accession No. 83-812861/45 (Jan. 7, 1983).

* cited by examiner

*Primary Examiner*—Michael Barr
*Assistant Examiner*—Jason Y Ko
(74) *Attorney, Agent, or Firm*—Klarquist Sparkman, LLP

(57) ABSTRACT

A parts washer having a cleaning chamber and a receptacle into which parts to be cleaned are placed. The receptacle is rotatably mounted within the cleaning chamber and is rotated by a drive device. One or more spray manifolds are provided, each having a plurality of spray jets arranged to spray cleaning fluid onto the parts in the receptacle. The spray manifolds are moveably mounted within the cleaning chamber and are coupled to the drive device such that the drive device causes reciprocating motion of the spray manifolds.

14 Claims, 6 Drawing Sheets

PARTS WASHER

CROSS REFERENCE TO RELATED APPLICATIONS

This is the U.S. National Stage of International Application No. PCT/AU2004/000502, filed Apr. 16, 2004, which claims the benefit of Australian Patent Application No. 2003901819, filed Apr. 16, 2003.

FIELD OF THE INVENTION

The present invention relates to a parts washer.

BACKGROUND OF THE INVENTION

Various industries, such as the automotive industry, require a method of cleaning mechanical components which are subject to a build up of dirt, grease and oil. It is known to provide a parts washer in which the components may be placed to be cleaned. Such washers generally include a cleaning chamber into which the parts are placed and a fluid reservoir in which is stored cleaning fluid. A pump is provided to pump the cleaning fluid from the reservoir into the cleaning chamber via jets within the chamber to clean the parts. The cleaning fluid is then returned to the fluid reservoir.

The effectiveness of the parts washer is determined, at least partly, by the pressure of the cleaning fluid from the jets within the chamber. In order to provide higher pressure jets within the chamber, it is necessary to either increase the pressure provided by the pump or to decrease the number of jets. Both of these methods however have limitations. Providing higher pressure from the pump may require changing the pump itself and associated piping, leading to increased costs. Reducing the number of jets is also often not practical as this reduces the area within the parts washer impacted by the jets. An alternative method of increasing the pressure is by decreasing the size of the jets. This, however, can lead to increased likelihood of the jets blocking up.

A method of effectively increasing the pressure of fluid from the jets however would have the advantage of allowing lower strength cleaning agents to be used and/or lower temperatures in the parts washer. This would allow more environmentally friendly cleaning agents to be used and allow more efficient recycling and disposal of the waster water.

The present invention attempts to overcome at least in part the aforementioned disadvantages of previous parts washers.

SUMMARY OF THE INVENTION

In accordance with one aspect of the present invention there is provided a parts washer comprising:

a cleaning chamber;

a receptacle into which parts to be cleaned are placed, the receptacle being rotatably mounted within the cleaning chamber;

a receptacle drive means arranged to rotate the receptacle; and one or more spray manifolds, the or each spray manifold having a plurality of spray jets arranged to spray cleaning fluid onto the parts in the receptacle;

wherein the or each spray manifold is moveably mounted within the cleaning chamber and is coupled to a spray manifold drive means such that the spray manifold drive means causes reciprocating motion of the or each spray manifold.

BRIEF DESCRIPTION OF THE DRAWINGS

The present invention will now be described, by way of example, with reference to the accompanying drawings, in which.

DESCRIPTION OF THE INVENTION

Figure 1:
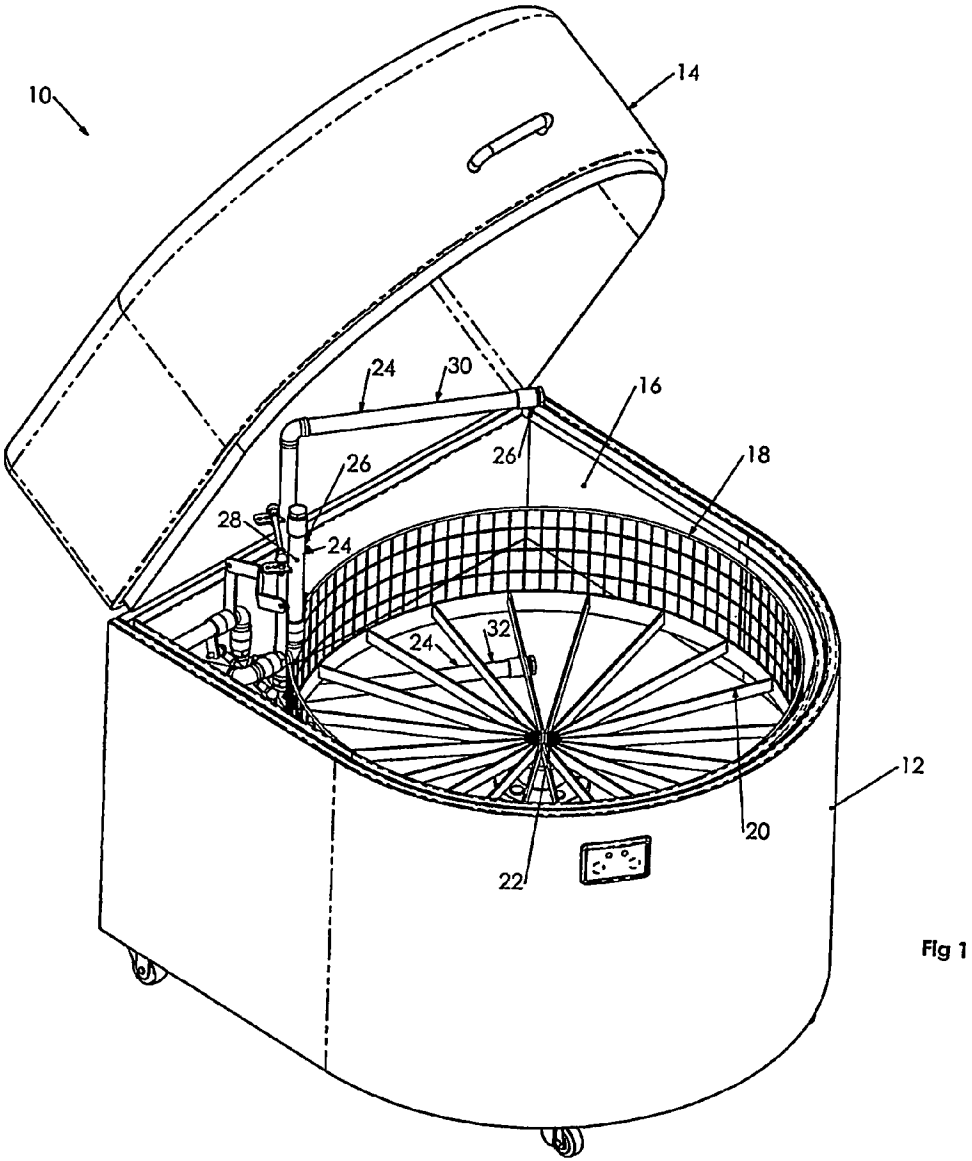
FIG. 1 is a perspective view of a parts washer in accordance with the present invention.
Figure 2B:
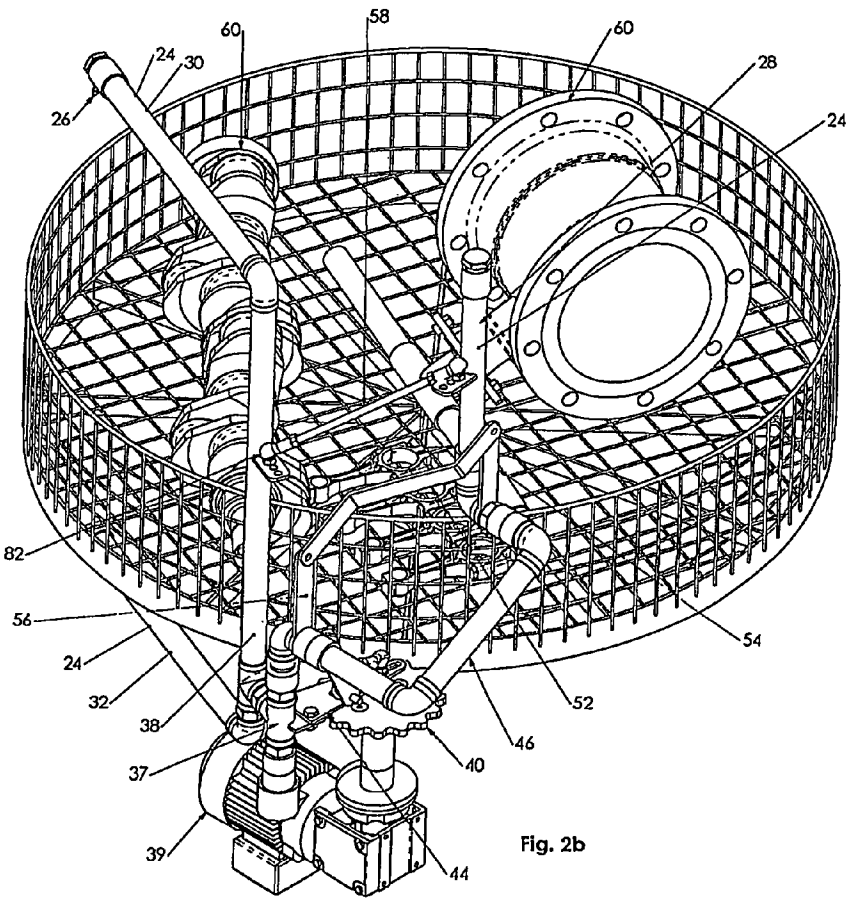
FIG. 2*b* is a rear perspective view of the parts washer of FIG. 2*a;*
Figure 2A:
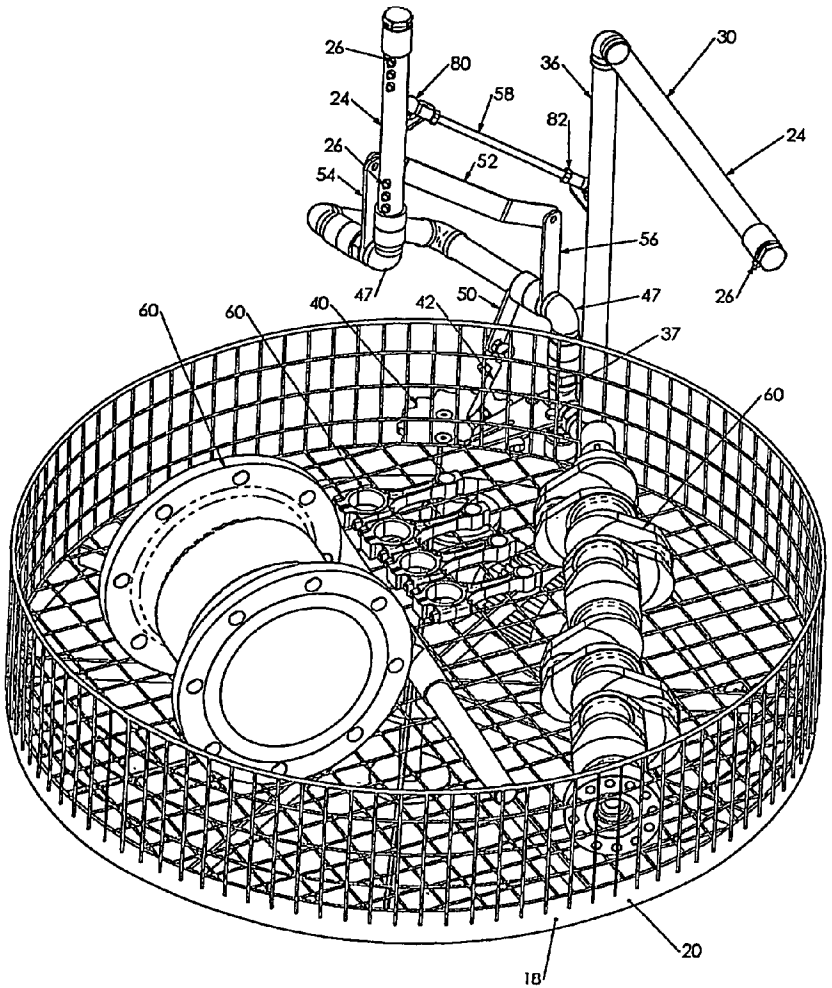
FIG. 2*a* is a front perspective view of the parts washer of FIG. 1 with the cabinet removed.
Figure 3B:
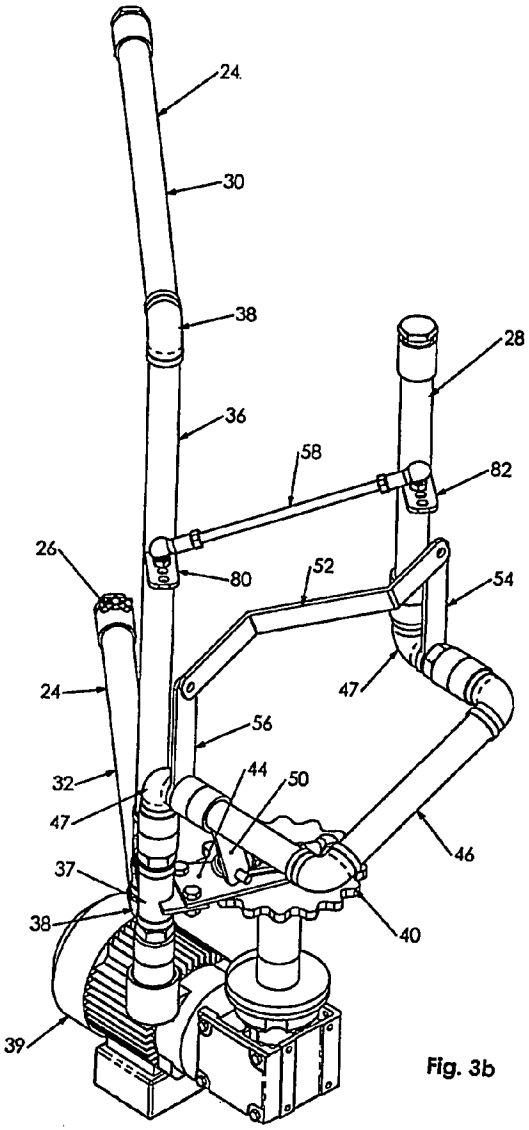
FIG. 3*b* is a rear perspective view of the parts washer of FIG. 3*a;*
Figure 3A:
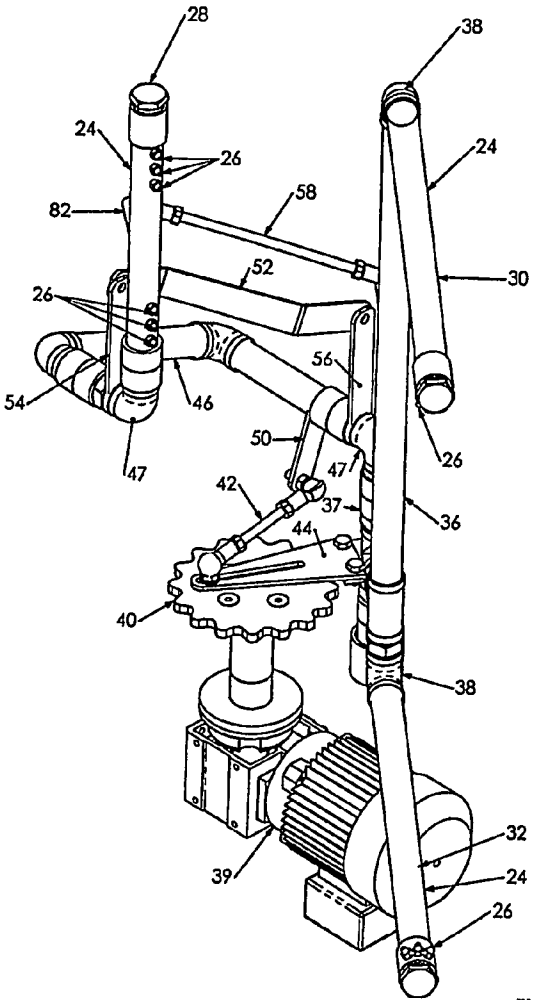
FIG. 3*a* is a front perspective view of the parts washer of FIG. 1 with the cabinet and basket removed.
Figure 4B:
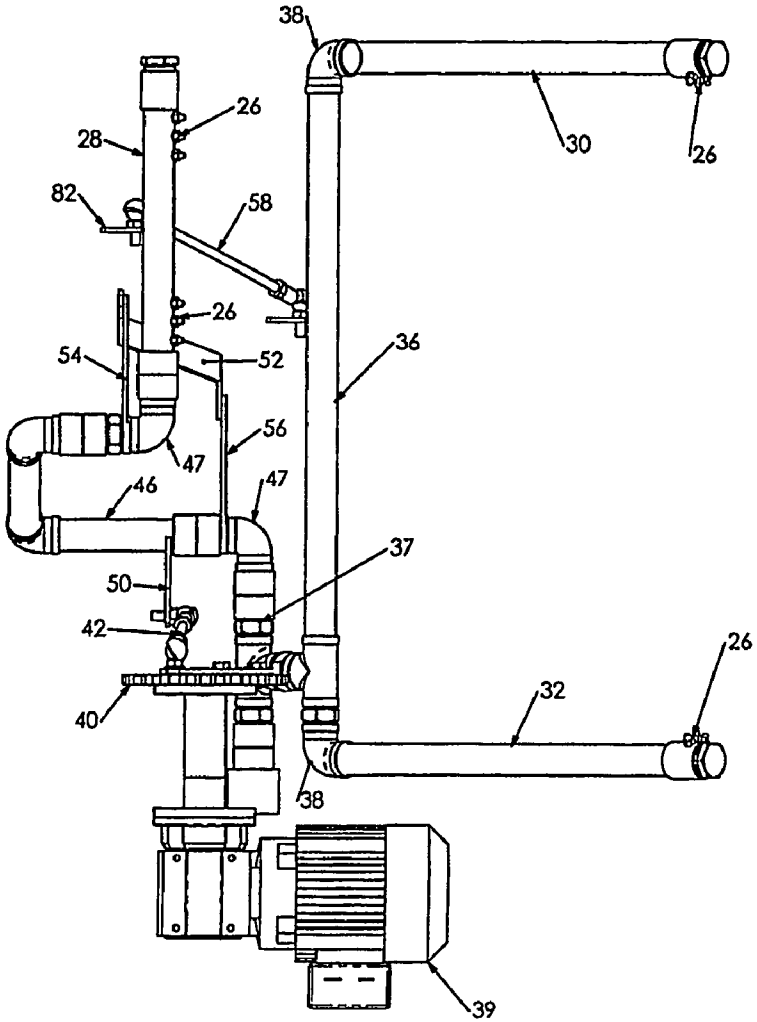
FIG. 4*b* is a front view of the parts washer of FIG. 4*a;*
Figure 4A:
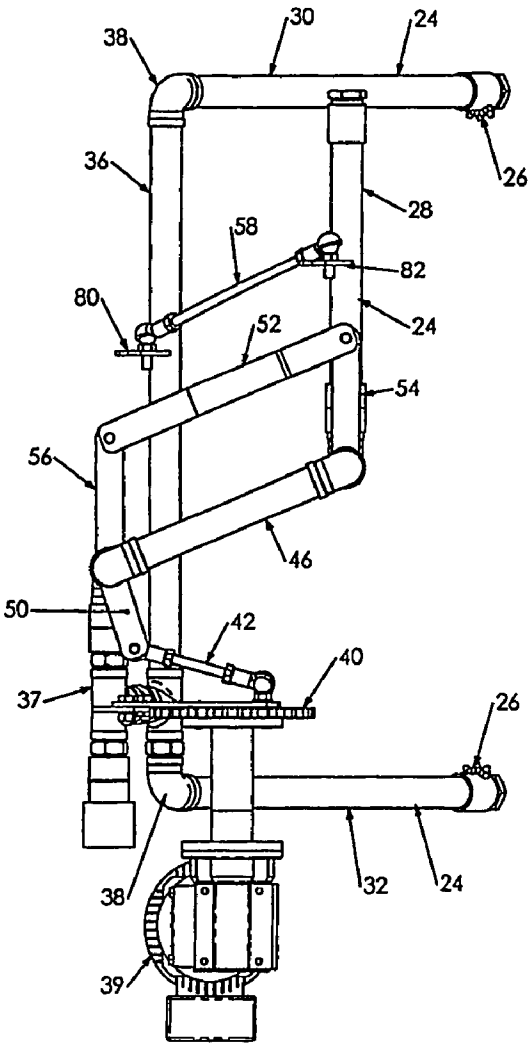
FIG. 4*a* is a first side view of the parts washer of FIG. 1 with the cabinet and basket removed.
Figure 4D:
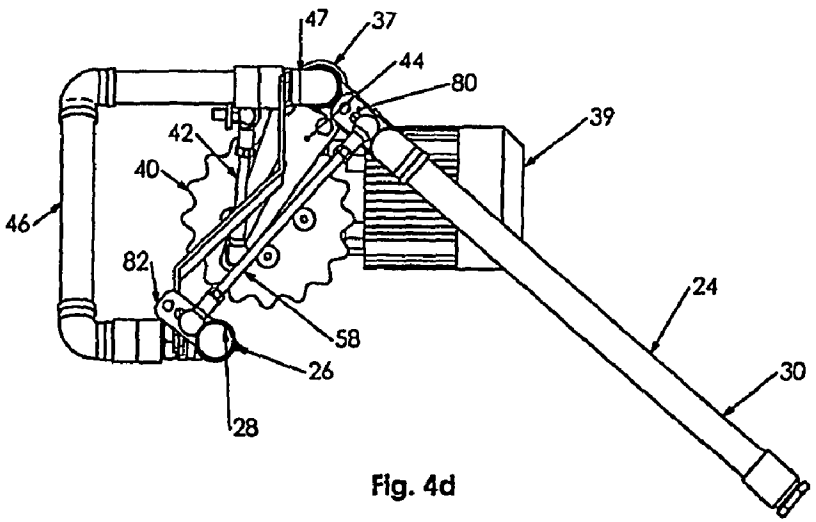
FIG. 4*d* is a top view of the parts washer of FIG. 4*a;*
Figure 4C:
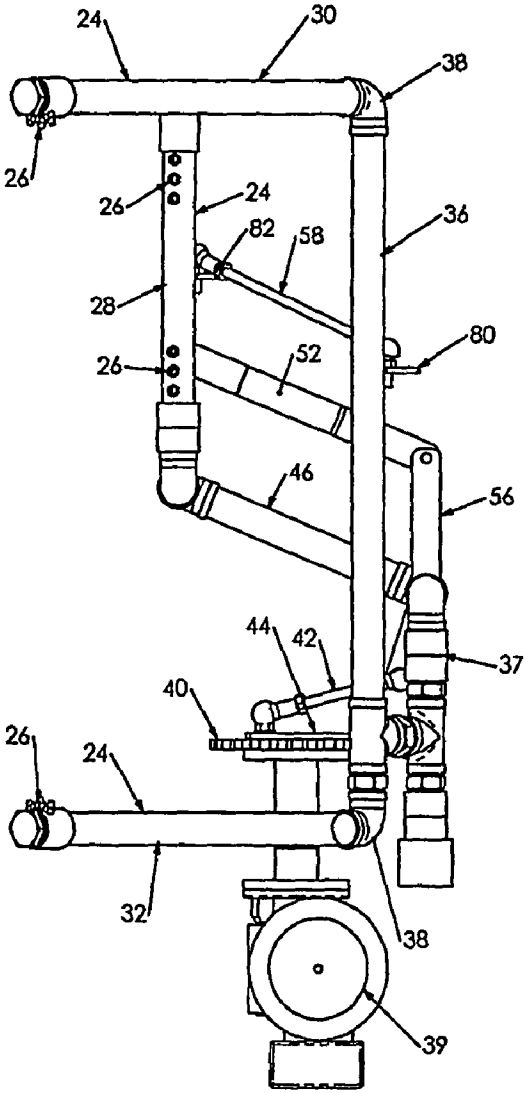
FIG. 4*c* is a second side view of the parts washer of FIG. 4*a;*

Referring to the Figures, there is shown a parts washer 10 comprising a cabinet 12 having a lid 14 defining a cleaning chamber 16 within the cabinet 12 when the lid 14 is closed.

The parts washer 10 includes a receptacle 18 rotatably mounted within the cleaning chamber 16. The receptacle comprises a circular basket 20 mounted on a central drive shaft 22. In use, parts 60 which are to be washed by the parts washer 10 are placed within the basket 20.

The parts washer 10 is provided with a receptacle drive means comprising a drive motor (not shown) connected to the drive shaft 22 such that the basket 20 is rotated about the drive shaft 22 in use.

The parts washer 10 includes a plurality of spray manifolds 24 having spray jets 26 thereon. In the embodiment shown in the drawings, the parts washer 10 includes a vertical spray manifold 28 and first and second horizontal spray manifolds 30 and 32. The vertical spray manifold 28 is arranged adjacent a side of the basket 20 with the spray jets 26 arranged to spray cleaning fluid in a generally horizontal direction towards the basket 20. The first horizontal spray manifold 30 is located above the basket 20 with the spray jets 26 arranged to spray cleaning fluid generally vertically downward towards the basket 20. The second horizontal spray manifold 32 is located below the basket 20 with the spray jets 26 arranged to spray cleaning fluid generally vertically upward towards the basket 20.

In the embodiment shown, each of the first and second horizontal spray manifolds 30 and 32 includes three spray jets 26 at an outer end thereof. Three spray jets 26 are provided at the upper end of the vertical spray manifold 28 and three spray jets are provided at the lower end of the vertical spray manifold 28.

Each of the spray jets 26 sprays a solid jet of cleaning fluid onto parts 60 in the basket 20. That is, the spray jets 26 spray cleaning fluid in a stream that does not diverge in the manner of known 'fan' jets. Further, each set of three spray jets 26 is arranged such that the spray jets 26 are directed in different directions. In the embodiment shown, each set of three spray jets 26 is arranged such that the central jet 26 is sprayed in a direction perpendicular to the spray manifold 24 with the outer two spray jets 26 angled away from the central jet 26 in a single plane. The use of multiple non-parallel, solid spray jets 26 provides for better cleaning of parts 60 with complex surface shapes.

The first and second horizontal spray manifolds 30 and 32 comprise pipes joined by an interconnecting manifold 36 arranged to extend alongside the basket 20 generally vertically between first ends 38 of the first and second horizontal spray manifolds 30 and 32. Also provided is an inlet manifold 37 which is provided with pressurised cleaning fluid from a fluid pump (not shown). The inlet manifold is in fluid communication with the first and second horizontal spray manifolds 30 and 32 and the vertical spray manifold 28 such that each of the spray manifolds 24 is supplied with pressurised cleaning fluid. The fluid pump recirculates cleaning fluid which collects in the bottom of the cleaning chamber 16 back through the spray manifolds 24.

The inlet manifold 37 is arranged generally vertically and is connected to and in fluid communication with the interconnecting manifold 38. A lower end of the inlet manifold 37 is connected to the fluid pump and an upper end of the inlet manifold 37 is connected to a lower end of the vertical spray manifold 28 by a generally U-shaped pipe 46. The lower end of the vertical spray manifold 28 and the upper end of the inlet manifold 27 are each provided with a ninety degree elbow 47 such that the U-shaped pipe 46 extends in a generally horizontal direction from both the vertical spray manifold 28 and the inlet manifold 37. Also, the ends of the U-shaped pipe 46, the upper end of the inlet manifold 37 and the lower end of the vertical spray manifold 28 are rotatably received within the elbows 47.

Also provided is a spray manifold drive means for causing reciprocating movement of the spray manifolds 24. The spray manifold drive means comprises a motor 39 arranged to rotate a drive wheel 40 about a generally vertical axis.

The drive wheel 40 is provided with a first cam member in the form of a cam plate 44 connected between a point on the drive wheel offset from the axis of rotation of the drive wheel 40 and the inlet manifold 37. The connection between the cam plate 44 and the drive wheel 40 is via a lug on the drive wheel 40 which is received in a slot 45 in the cam plate 44. Rotation of the drive wheel 40 thereby causes the inlet manifold 37 to undergo reciprocating rotation about its longitudinal axis. The interconnecting manifold 38 also therefore undergoes reciprocating rotational movement, thereby causing the first and second horizontal spray manifolds 30 and 32 to undergo reciprocating horizontal motion through an arc.

The drive wheel 40 is also provided with a second cam member in the for of a cam rod 42 connected between the lug on the drive wheel 40 and a first transverse bracket S0 extending from the U-shaped pipe 46 adjacent the inlet manifold 37. The cam rod 42 is pivotally connected to the first transverse bracket 50 such that rotation of the drive wheel 40 causes the U-shaped pipe 46 to undergo reciprocating rotational movement about the longitudinal axis of the connection to the elbow 47.

In order to maintain the vertical spray manifold 28 in a generally vertical orientation, a first interconnecting member 52 is provided. The first interconnecting member 52 is pivotally connected at a first end to a second transverse bracket 54 arranged to extend generally vertically from the U-shaped pipe 46 adjacent the vertical spray manifold 28. The first interconnecting member 52 is pivotally connected at a second end to a third transverse bracket 56 arranged to extend generally vertically from the U-shaped pipe 46 adjacent the inlet manifold 37. The reciprocating rotational motion of the U-shaped pipe 46 about the connection to the elbow 47 at the inlet manifold 37 is therefore translated to vertical reciprocating linear motion of the vertical spray manifold 28 along its longitudinal axis.

Also provided is a second interconnecting member 58 connected between the vertical spray manifold 28 and the interconnecting manifold 38. The second interconnecting member 58 is connected between a fourth transverse bracket 80 on the interconnecting manifold 38 and a fifth transverse bracket 82 on the vertical spray manifold 28. The second interconnecting member 58 causes the reciprocating rotational movement of the interconnecting manifold 38 about its longitudinal axis to be translated to the vertical spray manifold 28. The vertical spray manifold 28 also thereby undergoes reciprocating rotational movement about its longitudinal axis.

Figure 7A:
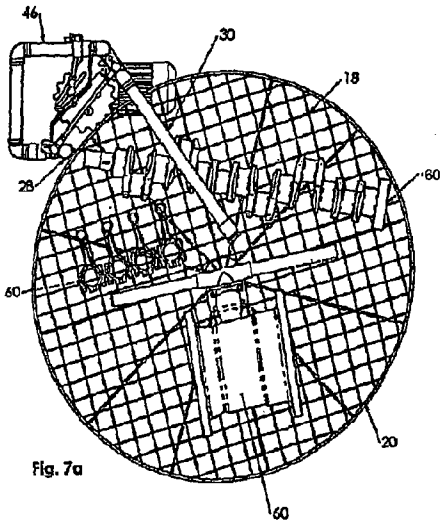
FIG. 7*a* is top view of the parts washer of FIG. 1 with the spray manifolds in a third position and with the basket and cabinet removed.
Figure 7B:
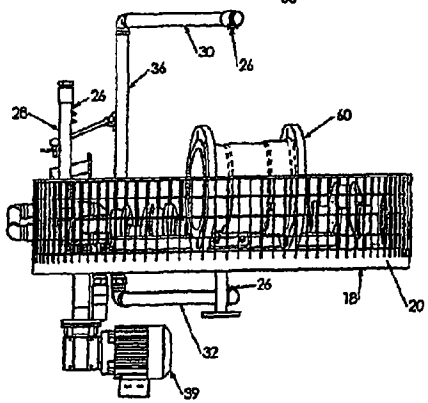
FIG. 7*b* is a side view of the parts washer of FIG. 7*a.*
Figure 6A:
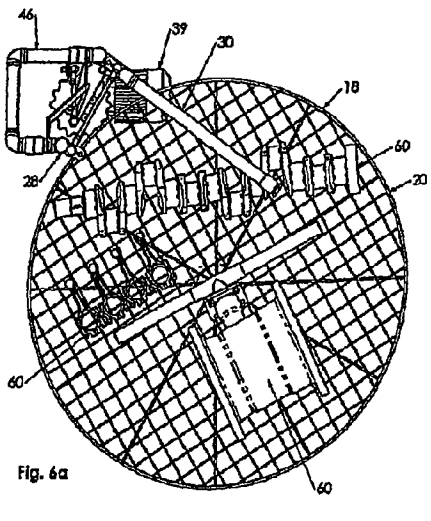
FIG. 6*a* is top view of the parts washer of FIG. 1 with the spray manifolds in a second position and with the basket and cabinet removed.
Figure 6B:
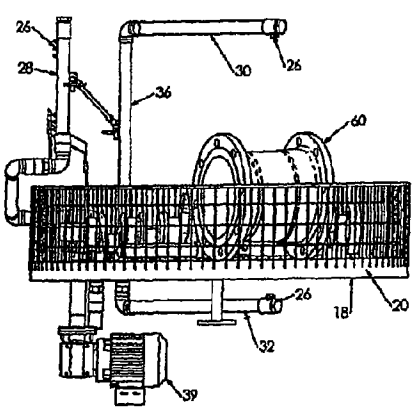
FIG. 6*b* is a side view of the parts washer of FIG. 6*a;*
Figure 5A:
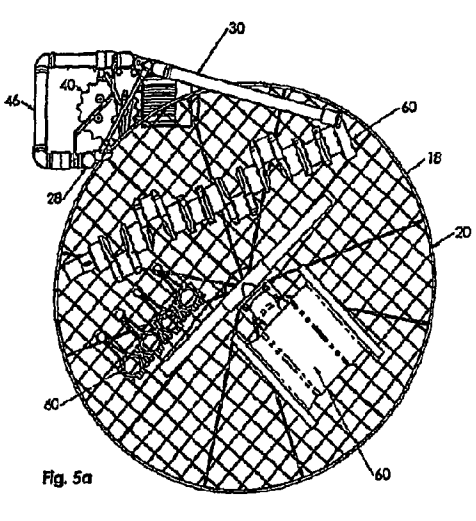
FIG. 5*a* is top view of the parts washer of FIG. 1 with the spray manifolds in a first position and with the basket and cabinet removed.
Figure 5B:
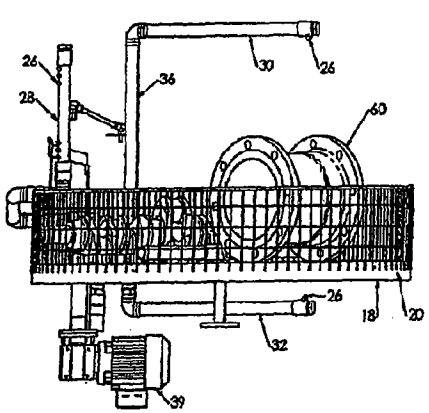
FIG. 5*b* is a side view of the parts washer of FIG. 5*a;*

Referring to FIGS. 5 to 7, the reciprocating motion of the spray manifolds 24 can be seen. In FIGS. 5*a*, 6*a* and 7*a*, the horizontal reciprocating pivotal motion of the horizontal spray manifolds 30 and 32 can be seen. In FIGS. 5*b*, 6*b* and 7*b*, the linear longitudinal reciprocating motion and the rotational reciprocating motion (which can be seen by reference to the position of the spray jets 26) of the vertical spray manifold 28 can be seen.

In use, the parts 60 to be cleaned are placed within the basket 20 of the parts washer 10 and the lid 14 is closed. The drive motor is activated to rotate the basket 20. The pump is also activated to supply cleaning fluid to the first and second horizontal spray manifolds 30 and 32 and the vertical spray manifold 28. The rotation of the drive wheel 40 causes horizontal reciprocating motion of the first and second horizontal spray manifolds 30 and 32 and reciprocating motion of the vertical spray manifold 28. The movement of the spray manifolds 24 allows all of the areas of the basket 20 to be impacted by the cleaning fluid during rotation of the basket 20.

The relative speeds of rotation of the basket 20 and the drive wheel 40, or other means may be used to determine the spray pattern generated over the basket 20. The parts washer 10 would be arranged such that after a single revolution of the basket 20, the spray manifolds 24 have undergone slightly more or slightly less than an intenger number of reciprocal movements. That is, during one rotation of the basket 20, the drive wheel 40 has rotated from a starting position through a number of revolutions to a position slightly offset from the starting position. In this way, the spray jets 26 impact on a different position on the parts 60 on each rotation of the basket 20.

The use of reciprocating motion of the spray manifolds 24 allows the use of solid cleaning jets as described previously with all of the area within the basket 20 still being impacted by the jets 26. The use of solid spray jets 26 provides better cleaning due to the increased pressure at which the cleaning fluid strikes the parts 20. This results in a number of possible benefits. Firstly, the increased pressure of the jets 26 allows for the use of a smaller pump size and reduces the incidence of blockages in the jets. Also, the improved cleaning results in decreased wash cycle times and allows for the use of lower strength detergents. For example, non-emulsifying detergents can be used, which would allow more efficient collection of the oil from the cleaning fluid and therefore increased life of the cleaning fluid and easier, more cost effective disposal. Further, the reduced wash cycle times means less energy usage and reduces the temperature rise of the parts being washed resulting in the parts being safer to handle.

Modifications and variations as would be apparent to a skilled addressee are deemed to be within the scope of the present invention.

The invention claimed is:

1. A parts washer comprising:

a cleaning chamber;

a receptacle into which parts to be cleaned are placed, the receptacle being rotatably mounted within the cleaning chamber;

a plurality of spray manifolds, each spray manifold having a plurality of spray jets arranged to spray cleaning fluid toward the receptacle, the spray manifolds being moveably mounted within the cleaning chamber and comprising at least one horizontal spray manifold coupled with an interconnecting manifold which extends in a generally vertical direction, the interconnecting manifold arranged to reciprocate in an arc about a vertical axis to cause the at least one horizontal manifold to undergo reciprocal movement in a generally horizontal plane and to spray cleaning fluid in a generally vertical direction toward the receptacle and a vertical spray manifold spaced from the interconnecting manifold and arranged to undergo reciprocal linear motion generally along a longitudinal axis of the vertical spray manifold to spray cleaning fluid in a generally horizontal direction toward the receptacle;

an inlet manifold coupled to, and in fluid communication with, both the interconnecting manifold and the vertical manifold, the inlet manifold supplying a common cleaning fluid simultaneously to the plurality of spray manifolds wherein the common cleaning fluid is sprayed simultaneously from the at least one horizontal spray manifold and the vertical spray manifold toward the receptacle; and a spray manifold drive motor coupled to the plurality of spray manifolds and arranged to simultaneously drive the at least one horizontal spray manifold and the vertical spray manifold wherein the at least one horizontal spray manifold and the vertical spray manifold simultaneously undergo their respective reciprocal motions.

2. The parts washer according to claim 1, wherein the reciprocal motion of the vertical spray manifold further comprises reciprocal rotational motion about its longitudinal axis.

3. The parts washer in accordance with claim 2, comprising a drive wheel coupled to and rotated by the spray manifold drive motor and a first cam member connected between the drive wheel and the inlet manifold such that the rotation of the drive wheel causes the reciprocal motion of the inlet manifold, and wherein the inlet manifold is coupled to the interconnecting manifold in a manner to cause the interconnecting manifold to reciprocate in the arc about the vertical axis.

4. The parts washer in accordance with claim 3, wherein the first cam member comprises a cam plate having a slot and the drive wheel comprises an off-centre lug engaged with said slot.

5. The parts washer in accordance with claim 4, comprising a pipe being rotatably connected between the inlet manifold and the vertical spray manifold and a second cam member connected between the drive wheel and the pipe such that rotation of the drive wheel causes the pipe to undergo reciprocal rotational movement which causes the reciprocal movement in the vertical plane of the vertical spray manifold.

6. The parts washer in accordance with claim 5, wherein the second cam member comprises a cam rod connected at a first end thereof to the off centre lug on the drive wheel and pivotally coupled at a second end thereof to the pipe.

7. The parts washer in accordance with claim 6, wherein the pipe is provided with an elbow between the inlet manifold and the vertical spray manifold and the cam rod is connected by a lever arm to the pipe, the lever arm connected to the pipe at a location between the elbow and the inlet manifold.

8. The parts washer in accordance with claim 1, wherein each of the spray jets sprays a solid, non-diverging stream of cleaning fluid.

9. The parts washer in accordance with claim 8, wherein the spray jets are directed to spray at varying angles in a single plane.

10. The parts washer in accordance with claim 1, wherein the horizontal spray manifolds are provided with a plurality of spray jets at an outer end thereof.

11. The parts washer in accordance with claim 1, wherein the vertical spray manifold is provided with a plurality of spray jets at an upper end thereof and a plurality of spray jets at a lower end thereof.

12. The parts washer in accordance with claim 1, wherein the spray manifold drive motor is arranged such that after a single revolution of the receptacle, the spray manifolds are in a position offset from an initial position of the spray manifolds at the commencement of said revolution.

13. The parts washer in accordance with claim 1, wherein the receptacle comprises a basket mounted on a central drive shaft.

14. The parts washer in accordance with claim 1, wherein the at least one horizontal spray manifold comprises a first horizontal spray manifold located above the receptacle having spray jets directed downwardly toward the receptacle and a second horizontal spray manifold located below the receptacle having spray jets directed upwardly toward the receptacle.

* * * * *